US006926401B2

(12) United States Patent
Yamamoto

(10) Patent No.: US 6,926,401 B2
(45) Date of Patent: Aug. 9, 2005

(54) SORTER FOR INK-JET PRINTER

(75) Inventor: Junichi Yamamoto, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 97 days.

(21) Appl. No.: 10/609,551

(22) Filed: Jul. 1, 2003

(65) Prior Publication Data

US 2004/0017464 A1 Jan. 29, 2004

(30) Foreign Application Priority Data

Jul. 1, 2002 (JP) ..... 2002-191604

(51) Int. Cl.[7] ..... B41J 2/01
(52) U.S. Cl. ..... 347/104; 347/101
(58) Field of Search ..... 347/104, 101, 347/108; 400/1, 625; 399/1

(56) References Cited

U.S. PATENT DOCUMENTS 5,567,068 A * 10/1996 Egashira et al. ..... 400/625
5,949,462 A * 9/1999 Esplin et al. ..... 347/108
6,144,468 A * 11/2000 Watanabe ..... 358/496

* cited by examiner

*Primary Examiner*—Manish S. Shah
(74) *Attorney, Agent, or Firm*—Smith Patent Office

(57) ABSTRACT

Printed papers discharged through a discharge port of an ink-jet printer can be sorted in accordance with their sizes either on an A4-size paper tray or on a L-size paper tray. Sorting openings with a determined width w are formed in the A4-size paper tray, on which printed papers are firstly held, each along a conveyance path for the papers. The width of the sorting opening is smaller than that of the A4-size paper and larger than that of the L-size paper. Therefore, A4-size papers stay on the A4-size paper tray. On the other hand, L-size papers pass through the sorting opening of the A4-size paper and then conveyed to the L-size paper tray by a conveyor.

10 Claims, 4 Drawing Sheets

SORTER FOR INK-JET PRINTER

BACKGROUND OF THE INVENTION

1. Field of the Invention

The present invention relates to a sorter for an ink-jet printer for sorting printed papers in accordance with their sizes.

2. Description of Related Art

Generally in a conventional ink-jet printer, printed papers are discharged through a discharge port and then stacked in order on a tray or the like. In case of a printer having only one discharge port and one tray, after printing on papers different in size, the printed papers stacked on the tray must be sorted in accordance with their sizes, which is troublesome work.

In order to avoid the above troublesome work, a printer may be designed so that printed papers can be discharged through different discharge ports in accordance with the paper sizes. In this design, however, a mechanism for sorting papers in accordance with their sizes must be provided within a common conveyance path for the papers. In addition, different subsequent conveyance paths and discharge ports must be provided for the respective paper sizes. Therefore, the printer cannot but have a complicated construction made up of a large number of parts. Besides, it is difficult to hold down the cost.

SUMMARY OF THE INVENTION

An object of the present invention is to provide a sorter for an ink-jet printer capable of sorting printed papers in accordance with their sizes in a simple construction.

According to an aspect of the present invention, a sorter for an ink-jet printer comprises a holder for holding a print medium. The holder has an opening with a predetermined width in a conveyance path for a print medium on which printing has been performed.

According to the invention, after a print medium is held on the holder, the print medium drops down through the opening in case of having a width smaller than the predetermined width of the opening, and the print medium stays on the holder without passing through the opening in case of having a width larger than the predetermined width of the opening. Thus, even though any complicated mechanism for size sorting is not provided, only in a simple structure wherein an opening with a predetermined width is formed in a holder, print media on which printing has been performed can be sorted in accordance with their sizes by whether the width of each print medium is larger or smaller than the predetermined width. Because any complicated mechanism for size sorting is not required, the cost can be held down.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
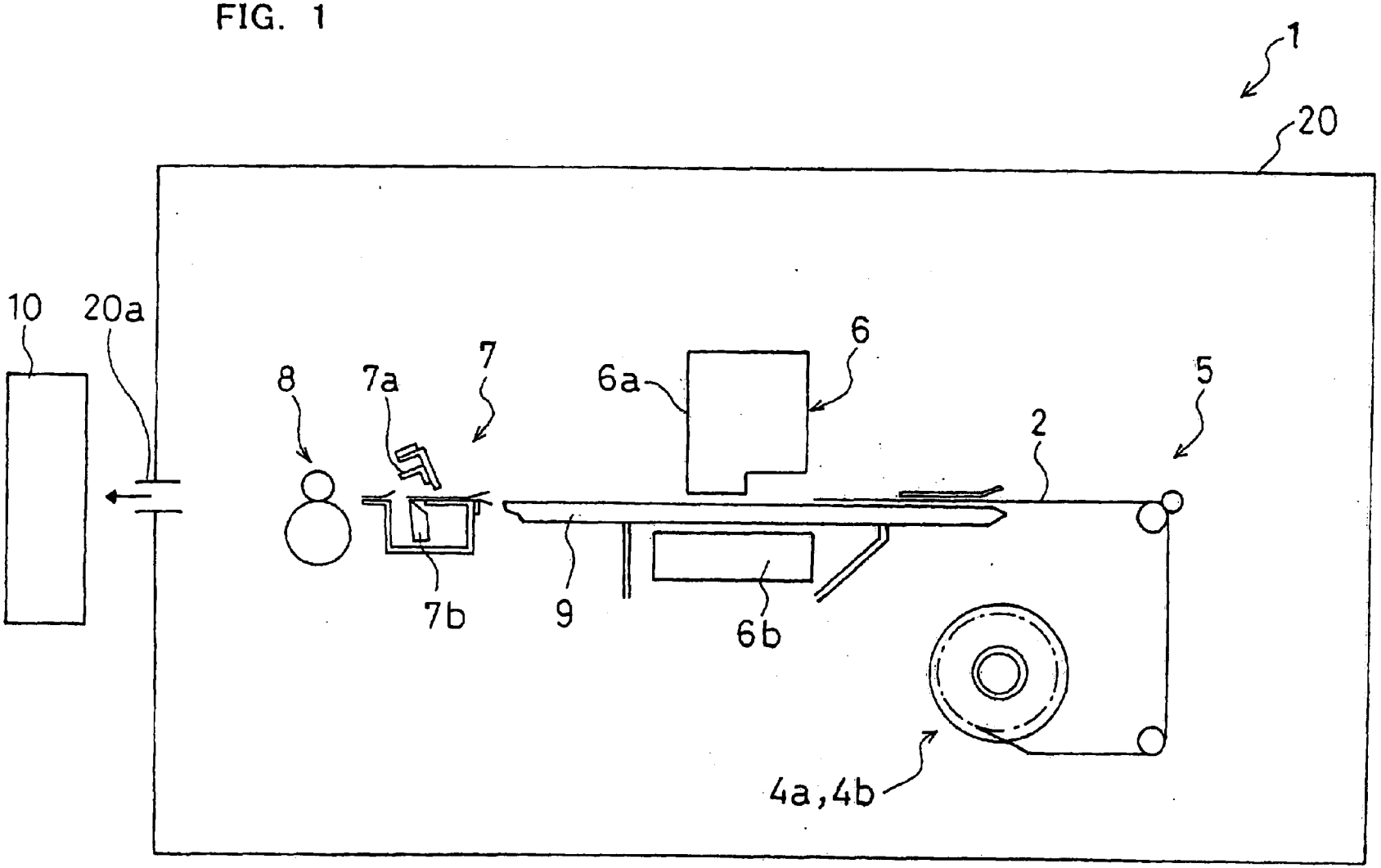
FIG. 1 illustrates a general construction of an ink-jet printer provided with a sorter according to an embodiment of the present invention.

First, an ink-jet printer provided with a sorter according to an embodiment of the present invention will be described with reference to FIG. 1. The ink-jet printer 1 includes, in a substantially rectangular parallelepiped casing 20, two paper roll housing units 4*a* and 4*b* each including a rolled long paper. Although FIG. 1 illustrates only one paper roll housing unit, two paper roll housing units 4*a* and 4*b* are arranged in a line perpendicular to FIG. 1. The ink-jet printer 1 further includes, in the casing 20, an advance roller unit 5 for advancing the paper 2 fed from each of the paper roll housing units 4*a* and 4*b*, an ink-jet printing unit 6 for printing on the paper 2, a cutting unit 7 for cutting the paper 2, and a discharge roller unit 8 for advancing the paper 2 cut into a predetermined size, to a discharge port 20*a*.

The advance roller unit 5 includes a pair of drive rollers. The advance roller unit 5 advances the paper 2 taken out from each of the paper roll housing units 4*a* and 4*b*, onto a table 9 and then to the ink-jet printing unit 6 and further to the cutting unit 7 in order.

The ink-jet printing unit 6 includes therein a printing head 6*a* and a suction fan 6*b* facing each other across a conveyance path for the paper 2. The printing head 6*a* prints a desired image on the upper face, in FIG. 1, of the paper 2 being conveyed. At this time, the suction fan 6*b* sucks the lower face, in FIG. 1, of the paper 2 so that the paper 2 is conveyed in close contact with the table 9 with keeping a constant distance from the printing head 6*a*. The ink-jet printing unit 6 can be various types such as a piezo jet type or a thermal jet type.

The cutting unit 7 includes therein a movable edge 7*a* and a fixed edge facing each other 7*b* across the conveyance path for the paper 2. Each of the movable and fixed edges 7*a* and 7*b* has a rectangular shape with a width somewhat larger than the width of the paper 2. The movable edge 7*a* is moved close to or away from the fixed edge 7*b*. Thereby, the cutting unit 7 cuts the printed paper 2 received from the printing unit 6, along the width of the paper 2.

The discharge roller unit 8 includes a pair of drive rollers. The discharge roller unit 8 advances the paper 2 cut into a predetermined size by the cutting unit 7, to the discharge port 20*a* and further to a sorter 10 disposed outside of the casing 20 to be close to the discharge port 20*a*, as will be described later.

The operation of the each above-described unit in the ink-jet printer 1 is under the control of a non-illustrated controller disposed within the casing 20. The controller supplies, to the printing unit 6, a print signal received from, e.g., an input device as will be described later. The controller supplies drive signals at proper conveyance timings to the paper roll housing units 4*a* and 4*b*, the advance roller unit 5, and the discharge roller unit 8. The controller controls the printing timing in the printing unit 6 and the cutting timing in the cutting unit 7.

Figure 2A:
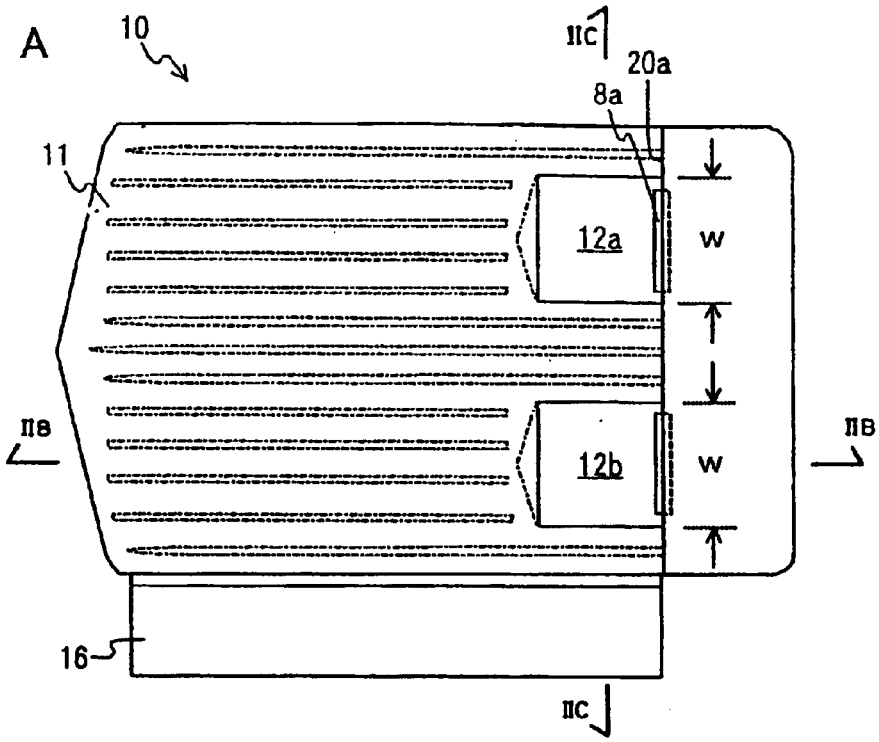
FIG. 2A is an upper view of the sorter according to the embodiment of the present invention.
Figure 2B:
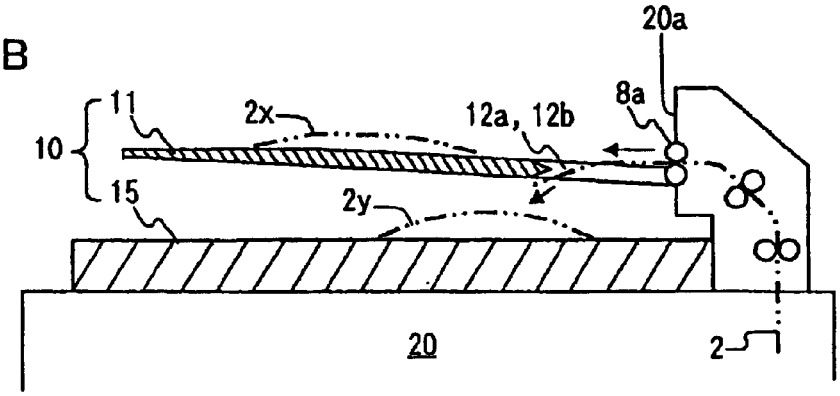
FIG. 2B is a sectional view taken along line IIB—IIB in FIG. 2A.
Figure 2C:
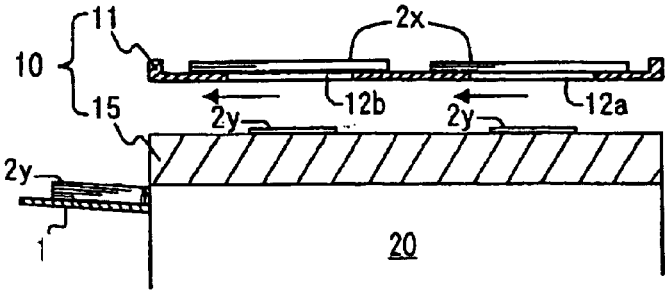
FIG. 2C is a sectional view taken along line IIC—IIC in FIG. 2A.

Next, the sorter 10 according to this embodiment will be described with reference to FIGS. 2A, 2B, and 2C. FIG. 2A is an upper view of the sorter 10. FIG. 2B is a sectional view taken along line IIB—IIB in FIG. 2A. FIG. 2C is a sectional view taken along line IIC—IIC in FIG. 2A.

After having come to the discharge port 20*a* of the ink-jet printer 1 of FIG. 1, the paper 2 is discharged through the discharge port 20*a* by the discharge roller unit 8, as described above. The paper 2 is then sent to the sorter 10. The sorter 10 includes an A4-size paper tray 11 for stacking thereon A4-size papers 2*x* each having a width of 210 mm and a length of 297 mm, and an L-size paper tray 16 for stacking thereon L-size papers 2*y* each having a width of 89 mm and a length of 127 mm.

As illustrated in FIG. 2A, the A4-size paper tray 11 is made of a substantially rectangular board on which a large number of ribs are formed along the conveyance direction. Two substantially rectangular sorting openings 12*a* and 12*b* each having a predetermined width w, w=100 mm in this embodiment, are formed in the board near the discharge port 20*a*. These two sorting openings 12*a* and 12*b* correspond to the conveyance paths for the papers 2 taken out from two paper roll housing units 4*a* and 4*b* of the ink-jet printer 1 of FIG. 1, respectively.

A pair of drive rollers 8*a* of the above-described discharge roller unit 8 is disposed within each of the sorting openings 12*a* and 12*b* of the A4-size paper tray 11 on the discharge port 20*a* side. The pair of drive rollers 8*a* preferably advances the paper 2 having come to the discharge port 20*a*, downstream along the length of the A4-size paper tray 11 and somewhat downward. Thereby, such a trouble can be avoided as a somewhat curved L-size paper 2*y* does not pass through the corresponding sorting opening 12*a* or 12*b* and consequently stays on the A4-size paper tray 12. though the width of the L-size paper 2*y* is smaller than the width w of the sorting opening 12*a* or 12*b*.

The downstream side face of each of the sorting openings 12*a* and 12*b* of the A4-size paper tray 11 is sharpened as illustrated in FIG. 2B. This is for avoiding such a trouble as a paper 2 being conveyed is stopped by the side face and thereby papers 2 are prevented from being smoothly sorted into sizes.

As illustrated in FIG. 2B, each L-size paper 2*y* having passed through the corresponding sorting opening 12*a* or 12*b* is held on a conveyor 15 provided below the A4-size paper tray 11. As illustrated in FIG. 2C, the L-size paper 2*y* is conveyed by the conveyor 15 perpendicularly to a conveying direction on the A4-size paper tray 11, and then drops from an end of the conveyor 15. Thus, L-size papers 2*y* are stacked in order on the L-size paper tray 16 disposed below the downstream end of the conveyor 15.

As described above, in the sorter 10 for an ink-jet printer according to this embodiment, after a paper 2 is discharged onto the A4-size paper tray 11, the paper 2 drops down through the corresponding sorting opening 12*a* or 12*b* in case of an L-size paper 2*y* with width of about 89 mm smaller than the predetermined width of 100 mm of the sorting opening 12*a* or 12*b* formed in the A4-size paper tray 11. Contrastingly, in case of an A4-size paper 2*x* with width of about 210 mm larger than the width of the sorting opening 12*a* or 12*b*, the paper 2 stays on the A4-size paper tray 11 without passing through the sorting opening 12*a* or 12*b*. Thus, even though any complicated mechanism for size sorting is not provided, only in a simple structure wherein the sorting openings 12*a* and 12*b* with a predetermined width w are formed in the A4-size paper tray 11, printed papers 2 can be sorted in accordance with their sizes by whether the width of each paper 2 is larger or smaller than the predetermined width w. Because any complicated mechanism for size sorting is not required, the cost can be held down.

The sorter 10 of this embodiment is provided outside the discharge port 20*a*, that is, outside the main body of the ink-jet printer 1. Therefore, printed papers 2 are conveyed in the same conveyance path in the main body of the ink-jet printer 1 irrespective of the paper sizes. The papers 2 are discharged through one discharge port 20*a* and then sorted by the A4-size paper tray 11 in which the sorting opening 12*a* or 12*b* are formed. If printed papers 2 are sorted before discharged through the discharge port 20*a*, the main body of the ink-jet printer 1 must include therein conveyance paths and discharge ports 20*a* for the respective paper sizes. In case of sorting outside the discharge port 20*a*, however, only one conveyance path and one discharge port 20*a* suffice. Thus, the construction of the main body of the ink-jet printer 1 is relatively simple. The simple construction of the main body of the ink-jet printer 1 can hold down the cost.

Further, because the sorter 10 includes the conveyor 15 below the A4-size paper tray 11, L-size papers 2*y* having passed through the sorting openings 12*a* and 12*b* of the A4-size paper tray 11 can be conveyed to the L-size paper tray 16 by the conveyor 15. Thus, such a trouble can be prevented as L-size papers 2*y* having passed through the sorting openings 12*a* and 12*b* of the A4-size paper tray 11 are stacked in order below the A4-size paper tray 11 and finally the space below the A4-size paper tray 11 is filled up with the stacked L-size papers 2*y*. In addition, even in case that the plural sorting openings 12*a* and 12*b* are formed in the A4-size paper tray 11, because L-size papers 2*y* on the conveyor 15 are conveyed perpendicularly to a conveying direction on the A4-size paper tray 11 and then stacked in order on the L-size paper tray 16, the L-size papers 2*y* can be arranged in a proper order.

Figure 3:
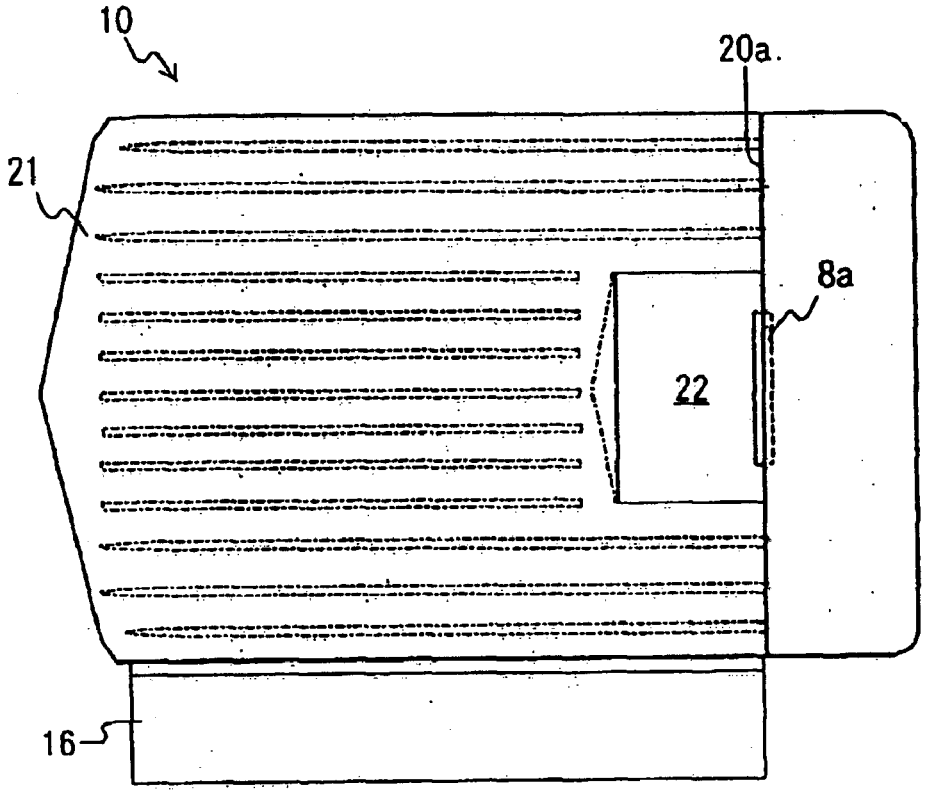
FIG. 3 is an upper view of a sorter according to a modification of the present invention.

The ink-jet printer 1 of this embodiment is a double magazine type in which two paper roll housing units 4*a* and 4*b* are provided, and accordingly two sorting openings 12*a* and 12*b* are formed in parallel. However, in case of a printer including only one paper roll housing unit, an A4-size paper tray 21 in which only one sorting opening 22 is formed, as illustrated in FIG. 3, can be used. Further, in case of a printer including three or more paper roll housing units, the corresponding number of sorting openings may be formed in a tray.

In this embodiment, the sorting openings 12*a* and 12*b* each having a predetermined width of 100 mm are formed in the A4-size paper tray 11 in order to sort papers into A4-size and L-size. However, the width w of the each of sorting openings 12*a* and 12*b* may vary in accordance with paper sizes to be sorted.

The conveyor 15 provided below the A4-size paper tray 11 may be omitted and further also the L-size paper tray 16 may be omitted. In this case, L-size papers 2*y* having passed through the sorting openings 12*a* and 12*b* of the A4-size paper tray 11 are stacked below the A4-size paper tray 11.

Further, in the above-described embodiment, the sorter 10 is provided outside the discharge port 20*a*, that is, outside the main body of the ink-jet printer 1, so that the A4-size paper tray 11 can receive papers discharged through the discharge port 20*a*. However, the present invention is not limited to this embodiment. For example, the sorter 10 may be provided within the main body of the ink-jet printer 1. In this case, papers 2 are sorted in accordance with their sizes within the main body of the ink-jet printer 1. The main body of the ink-jet printer 1 has discharge ports for the respective sorted paper sizes, i.e., two kinds of sizes in the above embodiment, and includes therein conveyance paths for the respective paper sizes from the sorter 10 to the respective discharge ports.

Figure 4:
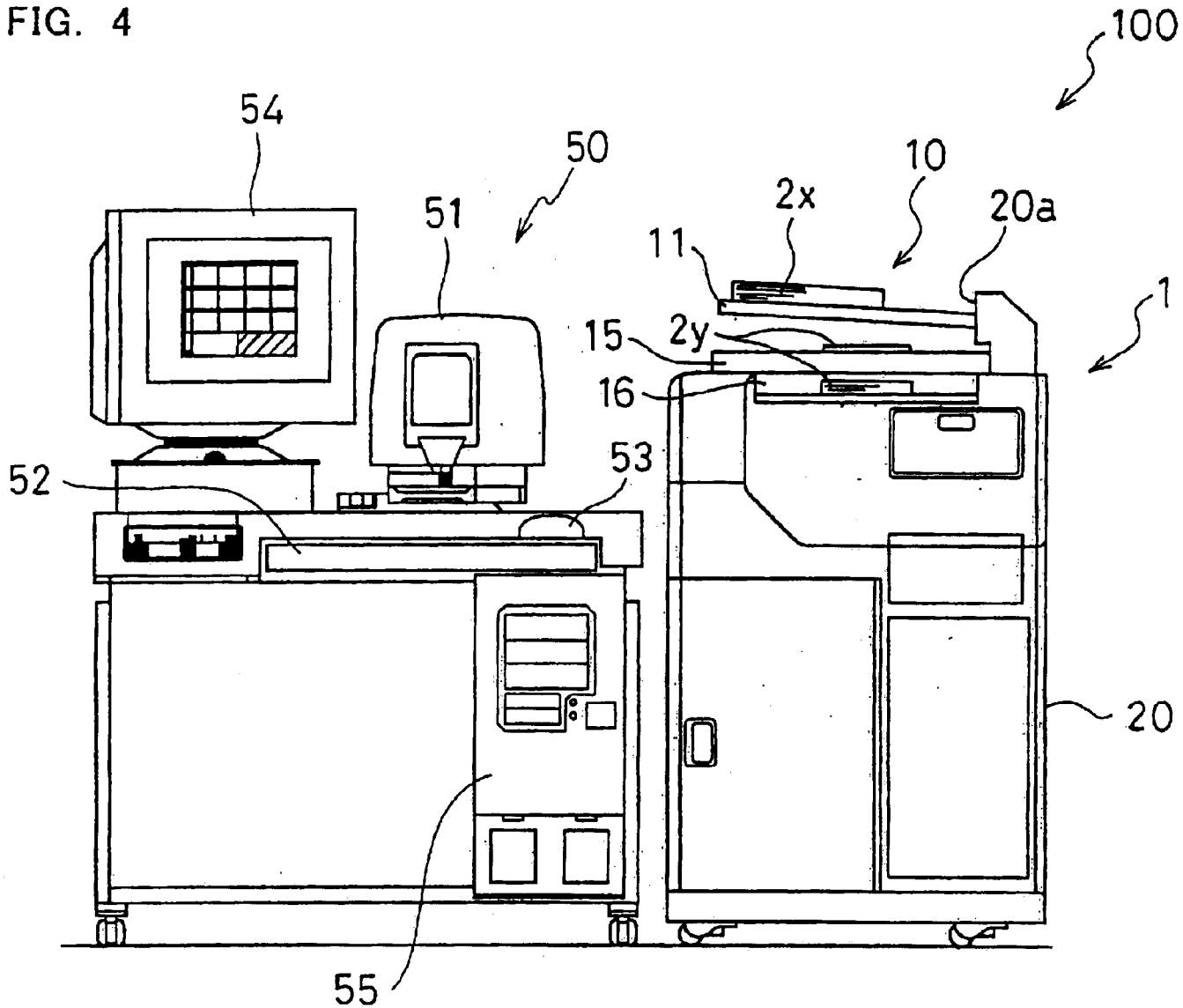
FIG. 4 illustrates an example of a print system including the ink-jet printer of FIG. 1.

As illustrated in FIG. 4, the ink-jet printer 1 provided with the sorter 10 of the above embodiment can be used in a print system 100 in which the ink-jet printer 1 is connected to an input system 50 via a non-illustrated cable or the like.

The input system 50 includes a scanner 51 for reading an image from a film or the like; a keyboard 52 and a mouse 53 for inputting the number of prints, compensation values for color and density, etc.; a monitor 54 for displaying various kinds of information about the print system 100 to an operator and for, as needed, urging an operator to input through the keyboard 52 and mouse 53; and a reader 55 for reading information such as an image from a storage medium supplied by the operator, such as a Smart Media, a Memory Stick, or a Compact Flash, each of which is a registered trademark. Using this input system 50, a print signal containing image data corresponding to an image to be printed, obtained by applying a predetermined process to an image signal from the scanner 51 or the reader 55, can be supplied to the non-illustrated controller of the ink-jet printer 1 as described above.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A sorter for an ink-jet printer, the sorter comprising a holder for holding a print medium, the holder having an opening formed therein, wherein the opening has a predetermined width and is positioned in a conveyance path for a print medium on which printing has been performed so that the holder holds a print medium with a width larger than the predetermined width and so that the opening allows a print medium with a width smaller than the predetermined width to drop from the holder through the opening.

2. The sorter according to claim 1, wherein the holder holds the print medium with the width larger than the predetermined width discharged through a discharge port of the ink-jet printer.

3. The sorter according to claim 1, further comprising a conveyor below the holder for conveying a print medium, which is dropped from the holder through the opening, perpendicularly to a conveying direction on the holder.

4. A sorter for an ink-jet printer, the sorter comprising a holder provided below a discharge port of the ink-jet printer for holding a print medium, the holder having an opening formed therein, wherein the opening has a predetermined width and is positioned in a conveyance path for a print medium on which printing has been performed so that the holder holds a print medium with a width larger than the predetermined width discharged through the discharge port and so that the opening allows a print medium with a width smaller than the predetermined width discharged through the discharge port to drop from the holder through the opening.

5. The sorter according to claim 4, further comprising a conveyor below the holder for conveying a print medium, which is dropped from the holder through the opening, perpendicularly to a discharge direction of the print medium from the discharge port.

6. An ink-jet printer comprising:

a housing having a discharge port; and a sorter comprising a holder provided below a discharge port of the ink-jet printer for holding a print medium, the holder having an opening formed therein, wherein the opening has a predetermined width and is positioned in a conveyance path for a print medium on which printing has been performed so that the holder holds a print medium with a width larger than the predetermined width discharged through the discharge port and so that the opening allows a print medium with a width smaller than the predetermined width discharged through the discharge port to drop from the holder through the opening.

7. The ink-jet printer according to claim 6, wherein the opening in the holder is a single opening formed therein.

8. The ink-jet printer according to claim 6, wherein the holder further comprises a plurality of openings formed therein.

9. The ink-jet printer according to claim 6, wherein the holder holds the print medium with the width larger than the predetermined width discharged through a discharge port of the ink-jet printer.

10. The ink-jet printer according to claim 6, further comprising a conveyor below the holder for conveying a print medium, which is dropped from the holder through the opening, perpendicularly to a conveying direction on the holder.

* * * * *